US005876036A

United States Patent [19]

Mathis

[11] Patent Number: 5,876,036

[45] Date of Patent: Mar. 2, 1999

[54] ONE-ON-ONE BASKETBALL GAME APPARATUS

[76] Inventor: Darryl Mathis, 4220 E. Johnson Ave., Pensacola, Fla. 32514

[21] Appl. No.: 967,427

[22] Filed: Nov. 10, 1997

[51] Int. Cl.[6] ..... A63F 7/06

[52] U.S. Cl. ..... 273/317.3

[58] Field of Search ..... 273/317.1, 317.3, 273/108.1, 108.55, 108.56, 399

[56] References Cited

U.S. PATENT DOCUMENTS

| | | | |
|---|---|---|---|
| 2,431,552 | 11/1947 | Gosnell | 273/317.3 |
| 2,433,224 | 12/1947 | Koci et al. | 273/317.3 |
| 2,720,397 | 10/1955 | Blanton | 273/317.3 |
| 3,074,720 | 1/1963 | Carver et al. | 273/317.3 |
| 3,960,378 | 6/1976 | Bahr . | |
| 4,260,152 | 4/1981 | Karlsen . | |
| 4,480,834 | 11/1984 | Minami . | |
| 5,150,898 | 9/1992 | Hochberg et al. . | |
| 5,288,071 | 2/1994 | Solomon . | |
| 5,480,147 | 1/1996 | Ethier et al. . | |

*Primary Examiner*—William H. Grieb
*Attorney, Agent, or Firm*—Joseph N. Breaux

[57] ABSTRACT

A basketball game apparatus comprising a playing field having first and second tracks embedded in a court floor, a target supported above the court floor and a basketball. A motorized defensive basketball player figurine coupled in the first track for movement therein and a motorized offensive basketball player figurine coupled in the second track for movement therein. First and second hand-held game control devices wherein each control device alternately controls the movement of the defensive basketball player figurine when in a defensive playing mode and the movement of the offensive basketball player figurine when in an offensive playing mode.

17 Claims, 4 Drawing Sheets

ONE-ON-ONE BASKETBALL GAME APPARATUS

TECHNICAL FIELD

The present invention relates to basketball amusement game apparatuses and, more particularly, to a one-on-one basketball game apparatus which allows two motorized basketball player figurines to move about one end of a basketball court wherein one basketball player figurine serves as a defensive player and the other basketball player figurine serves as an offensive player. Thereby, the two basketball player figurines play one-on-one basketball. The addition of a defensive basketball player figurine serves to enhance the competitiveness of the one-on-one basketball game apparatus.

BACKGROUND OF THE INVENTION

Several devices have been patented which are aimed at basketball amusement game apparatuses.

U.S. Pat. No. 5,480,147, by Ethier et al., entitled "BASKETBALL GAME ADJUSTMENT APPARATUS" discloses an arcade basketball game with a pair of inclined playing surfaces joined together in a peak with a transparent vertical barrier on top, allowing the ball to roll to the lowest point where a striker bar impedes its travel. A hand-held striker hits the ball upward at an angle toward the opposite player's hoop in an attempt to score a goal.

U.S. Pat. No. 5,288,071, by Solomon, entitled "GAME APPARATUS" discloses a game apparatus having a substantially rectangular base. A vertical plate is suspended over an end of the base by a support and has a hoop. A catapult is pivotally mounted to the opposite end of the base and has a receptacle for holding a ball which can be projected toward the hoop.

U.S. Pat. No. 5,150,898, by Hochberg et al., entitled "GAME APPARATUS" discloses a game apparatus having a projectile propeller mounted on a forward end portion of a housing. A target is provided which is mounted to translate forwardly and rearwardly with respect to the projectile propeller adjacent a rearward end of the housing. The projectile propeller is operable to propel a game projectile toward the target.

U.S. Pat. No. 4,480,834, by Minami, entitled "TOY HAVING MOMENTUM IMPARTING SURFACE" discloses a toy having a surface wherein a portion thereof is movable with respect to the remainder of the surface. A target is mounted on a pedestal above the surface and a self-propelled object.

Other games in the field are U.S. Pat. No. 4,260,152, by Karlsen, entitled "GAME" and U.S. Pat. No. 3,960,378, by Bahr, entitled "TARGET AND AIR ACTUATED PROJECTORS" are related to basketball game apparatuses but do not meet the needs of the present invention.

While each of the basketball amusement game apparatuses functions as desired, none of them allow two motorized basketball player figurines to move about one end of a basketball court wherein one basketball player figurine serves as a defensive player and the other basketball player figurine serves as an offensive player. Thereby, the two basketball player figurines play one-on-one basketball. The addition of a defensive basketball player figurine serves to enhance the competitiveness of the one-on-one basketball game apparatus.

SUMMARY OF THE INVENTION

The preferred embodiment of the one-on-one basketball game apparatus of the present invention solves the aforementioned problems in a straight forward and simple manner. What is provided is a one-on-one basketball game apparatus which allows two motorized basketball player figurines to move about one end of a basketball court wherein one basketball player figurine serves as a defensive player and the other basketball player figurine serves as an offensive player. Thereby, the two basketball player figurines play one-on-one basketball. The addition of a defensive basketball player figurine serves to enhance the competitiveness of the one-on-one basketball game apparatus.

A basketball game apparatus comprising: a playing field having first and second tracks embedded in a court floor; a target supported above said court floor; a motorized defensive basketball player figurine coupled in said first track for movement therein; a motorized offensive basketball player figurine coupled in said second track for movement therein; first and second hand-held game control devices wherein each control device of said first and second hand-held control devices alternately controls the movement of said defensive basketball player figurine when in a defensive playing mode and the movement of said offensive basketball player figurine when in an offensive playing mode; and, a basketball member.

In view of the above, an object of the present invention is to provide a one-on-one basketball game apparatus having a motorized defensive basketball player figurine and a motorized offensive basketball player figurine wherein the defensive basketball player figurine is controlled to prevent the offensive basketball player figurine from scoring points by blocking the basketball from entering the target, a basketball goal.

Another object of the present invention is to provide a one-on-one basketball game apparatus which has two concentric arch-shaped tracks which allow motorized basketball player figurines to move from one side of the playing field to the other side of the playing field along their respective tracks. The defensive basketball player figurine moves along the interior arch-shaped track closest to the goal and the offensive basketball player figurine moves along the exterior arch-shaped track farthest from the target, a basketball goal.

A further object of the present invention is to provide a one-on-one basketball game apparatus which comprises a first and second hand-held game control devices wherein each hand-held game control devices allows a respective player to alternately control the defensive basketball player figurine when in a defensive playing mode and the offensive basketball player figurine when in an offensive playing mode.

It is a still further object of the present invention to provide a one-on-one basketball game apparatus which comprises a first and second score/time keeping panel which automatically displays the score for the first player and second player, respectively, of the one-on-one basketball game apparatus. The first and second score/time keeping panel alternately count down a predetermined time interval for its respective player wherein such player has control of the offensive basketball player figurine. After the expiration of such predetermined time interval, the one-on-one basketball game apparatus automatically switches each hand-held game control device to the other playing mode, i.e., from the offensive playing mode to the defensive playing mode and from the defensive playing mode to the offensive playing mode.

It is a still further object of the present invention to provide a one-on-one basketball game apparatus which comprises a defensive basketball player figurine which essentially resembles a basketball player wherein such defensive basketball player figurine maintains an erect position with its arms fully extended above its head to block the ball.

It is a still further object of the present invention to provide a one-on-one basketball game apparatus which comprises an offensive basketball player figurine which essentially resembles a basketball player wherein such offensive basketball player figurine maintains a basketball shooting posture whereby one of the hands serves as a support to rest the basketball thereon and the other hand serves to apply a force of pressure to the basketball to propel the basketball forward in the direction of the target, a basketball goal.

In view of the above objects, it is a feature of the present invention to provide a one-on-one basketball game apparatus which is simple to use and play.

Another feature of the present invention is to provide a one-on-one basketball game apparatus which is fun to play.

A further feature of the present invention is to provide a one-on-one basketball game apparatus which is simple to manufacture.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
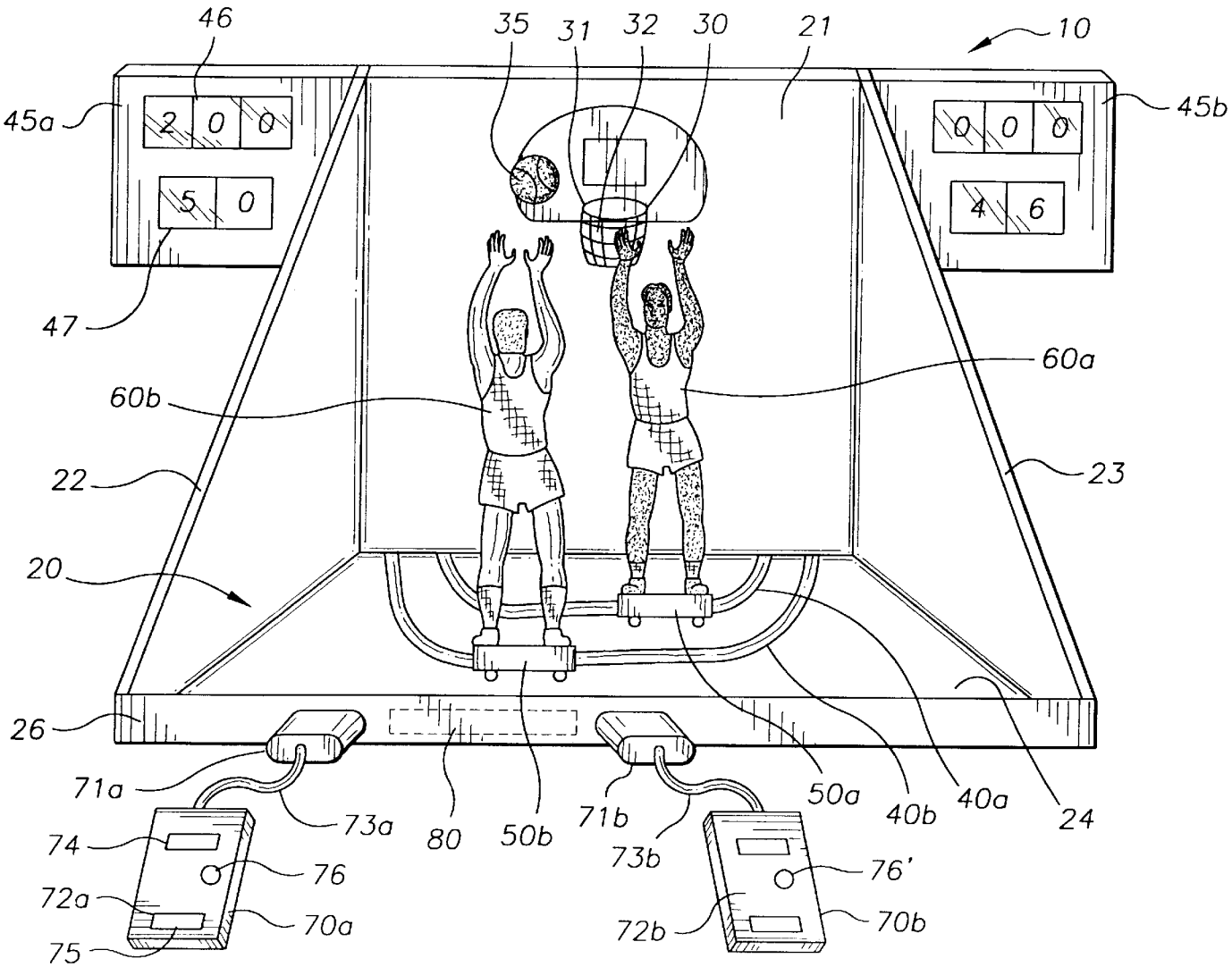
FIG. 1 illustrates a front perspective view of the preferred embodiment of the one-on-one basketball game apparatus of the present invention.
Figure 2:
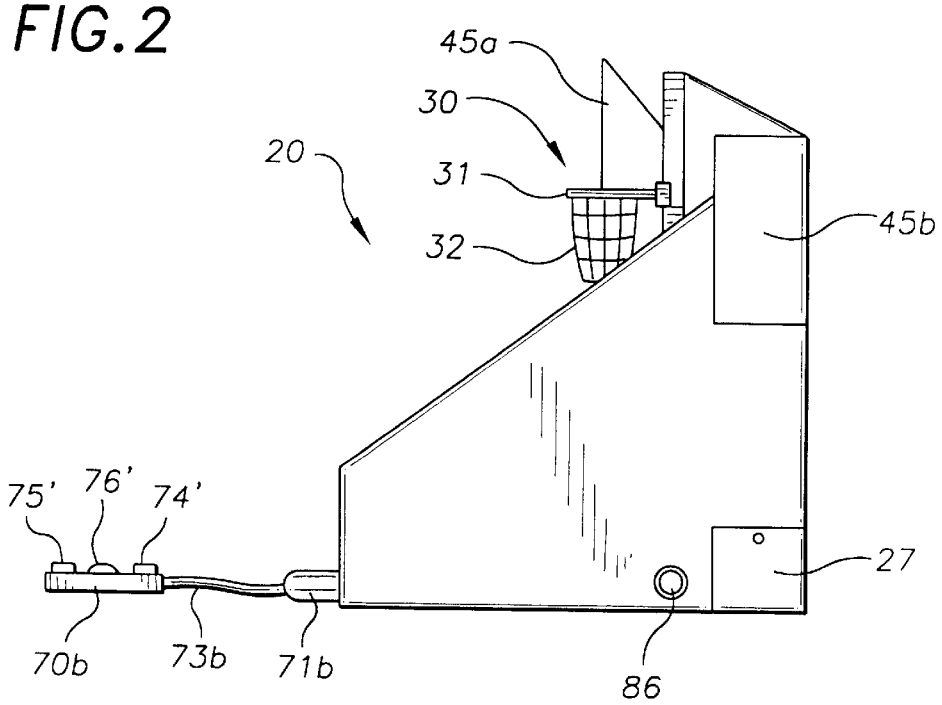
FIG. 2 illustrates a side perspective view of the playing field of the one-on-one basketball game apparatus of the embodiment of FIG. 1.
Figure 3:
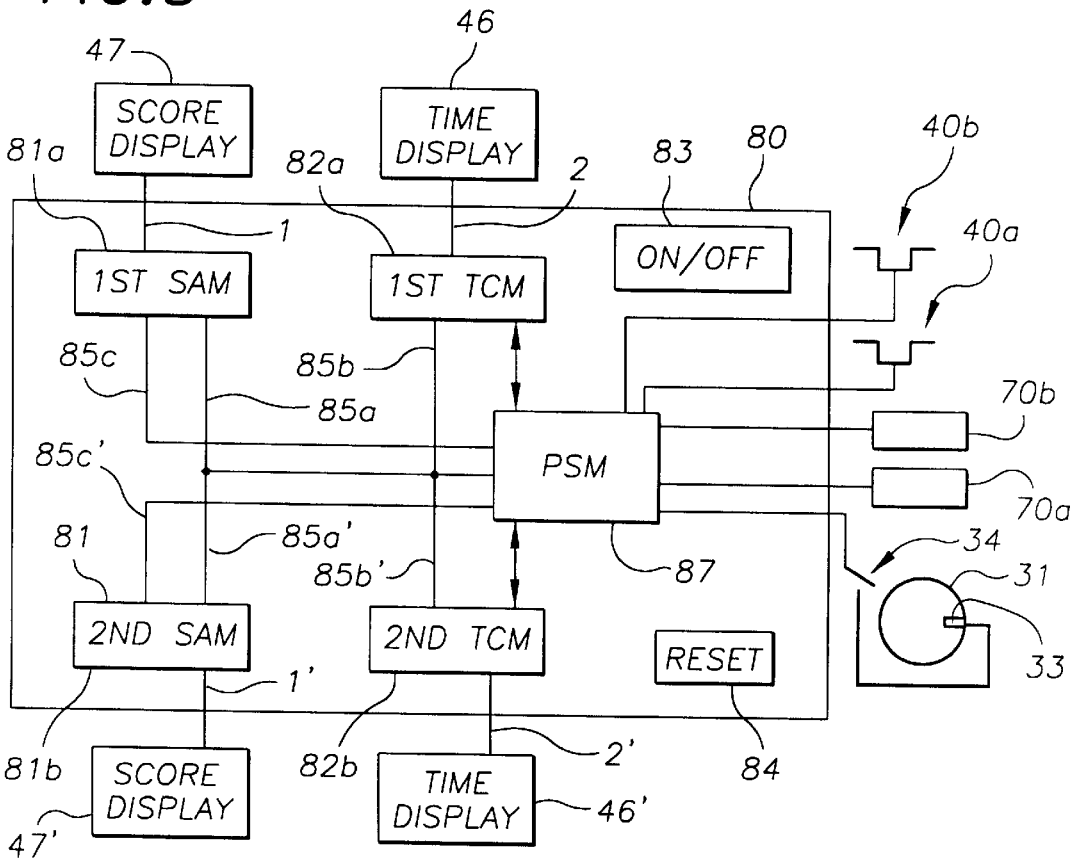
FIG. 3 illustrates the schematic diagram of the game control means of the present invention for controlling the operation thereof.

Referring now to the drawings, and in particular FIG. 1, 2 and 3, the one-on-one basketball game apparatus of the present invention is designated generally by the numeral 10. One-on-one basketball game apparatus 10 is comprised of playing field 20, target 30, basketball 35, first and second tracks 40*a* and 40*b,* first and second score/time keeping panels 45*a* and 45*b,* first and second player propulsion means 50*a* and 50*b,* defensive basketball player figurine 60*a,* offensive basketball player figurine 60*b,* first and second hand-held game control devices 70*a* and 70*b* and game control means 80.

Referring now to FIG. 3, game control means 80 comprises first score accumulating mechanism (SAM) 81*a,* second score accumulating mechanism (SAM) 81*b,* first time counting mechanism (TCM) 82*a* and second time counting mechanism (TCM) 82*b,* on/off switch means 83, reset button means 84 and player switching means (PSM) 87. First score accumulating mechanism (SAM) 81*a* and second score accumulating mechanism (SAM) 81*b* each comprise a counter for accumulating the score for the first player and the second player, respectively, playing one-on-one basketball game apparatus 10. First score accumulating mechanism (SAM) 81*a* and second score accumulating mechanism (SAM) 81*b* are resettable via reset button means 84 coupled to player switching means (PSM) 87. Player switching means (PSM) 87 resets first score accumulating mechanism (SAM) 81*a* and second score accumulating mechanism (SAM) 81*b,* respectively, rest control lines 85*a* and 85*a′,* respectively, when reset button means 84 is pressed or when power is turned on via on/off switch means 83.

Additionally, player switching means (PSM) 87 serves to control first score accumulating mechanism (SAM) 81*a* and second score accumulating mechanism (SAM) 81*b,* respectively, via control lines 85*c* and 85*c′,* respectively, when a score is made. During the first players turn of controlling offensive basketball player figurine 60*a,* if target 30 is made, player switching means (PSM) 87 controls first score accumulating mechanism (SAM) 81*a* to increase the count. For example, such count may be increased by 2 counts. Likewise, during the second players turn of controlling offensive basketball player figurine 60*b,* if target 30 is made, player switching means (PSM) 87 controls second score accumulating mechanism (SAM) 81*b* to increase the count.

First time counting mechanism (TCM) 82*a* and second time counting mechanism (TCM) 82*b* are counters set to a predetermined time interval and count down until the counters reach zero. In operation, only one of first time counting mechanism (TCM) 82*a* and second time counting mechanism (TCM) 82*b* count at any time. In the preferred embodiment, the predetermined time interval is at least 2 minutes wherein during said predetermined time interval, one of the respective players gets a turn to attempt to achieve the most number of goals in the predetermined time interval. Alternately, the game may switch between players if the predetermined time interval has not expired and target 30 has been made. After the first time counting mechanism (TCM) 82*a* or second time counting mechanism (TCM) 82*b* reach zero, the other of first time counting mechanism (TCM) 82*a* or second time counting mechanism (TCM) 82*b* is automatically set to said predetermined time interval and proceeds to count down to zero. First time counting mechanism (TCM) 82*a* and second time counting mechanism (TCM) 82*b* are in communication with player switching mechanism (PSM) 87. Thereby, when first time counting mechanism (TCM) 82*a* and second time counting mechanism (TCM) 82*b* reach zero, player switching mechanism (PSM) 87 controls first and second hand-held game control devices 70*a* and 70*b* and switches its operation between players.

Player switching means 87 serves to control first and second hand-held game control devices 70*a* and 70*b*. When on/off switch means 83 is turned on first hand-held game control device 70*a* functions in an offensive mode for controlling offensive basketball player figurine 60*b* and second hand-held game control device 70*b* functions in a defensive mode for controlling defensive basketball player figurine 60*a*. First time counting mechanism (TCM) 82*a* is set to the predetermined time interval and proceeds to count down to zero. After first time counting mechanism (TCM) 82*a* reaches zero, player switching means 87 serves to switch first hand-held game control device 70*a* from said offensive mode to said defensive mode for controlling defensive basketball player figurine 60*a* and second hand-held game control device 70*b* is switched from the defensive mode to the offensive mode for controlling offensive basketball player figurine 60*b*. Thereafter, the second player controls the offensive basketball player figurine 60*b* until second time counting mechanism (TCM) 82*b* counts down to zero. After second time counting mechanism (TCM) 82*b* reaches zero, player switching means 87 serves to switch first hand-held game control device 70*a* from said defensive mode back to said offensive mode for controlling offensive basketball player figurine 60*b* and second hand-held game control device 70*b* is switched from the offensive mode back to the defensive mode for controlling defensive basketball player figurine 60*a*. Each player of one-to-one basketball game apparatus 10 is given a predetermine amount of turns in which to control offensive basketball player figurine 60*b*. Alternatively, after the predetermine amount of turns one-on-one basketball game apparatus 10 may produce an audio response via a audio system (not shown) indicating that the game is over.

Referring now to FIGS. 1 and 2, playing field 20 comprises first wall 21, second wall 22, third wall 23, and floor member 24. Floor member 24 is a flat planar surface having embedded therein first and second tracks 40*a* and 40*b*. The back edge of floor member 24 has perpendicularly coupled thereto first wall 21. First wall 21 has coupled thereto a predetermined distance above floor member 24 target 30 wherein target 30 is a basketball goal. The side edges of floor member 24 have perpendicularly coupled thereto second wall 22 and third wall 23, respectively. In the preferred embodiment, in lieu of a generally square-shaped wall, second wall 22 and third wall 23 are substantially triangularly-shaped wherein the hypotenuse of the triangularly-shaped walls extends from the front to the back of the sides of floor member 24.

One of the walls of playing field 20 has formed therein a power port 86 for coupling thereto power from a conventional power outlet. Additionally one wall of playing field 20 has formed therein battery housing 27 for housing therein the power source for energizing first and second player propulsion means 50*a* and 50*b*, for motorizing defensive and offensive basketball player figurines 60*a* and 60*b*, first and second tracks 40*a* and 40*b*, first and second score/time keeping panels 45*a* and 45*b* and game control means 80. In the preferred embodiment, power port 86 and battery housing 27 having a door is formed in third wall 23. Nevertheless, any wall may be used.

The corner formed by first wall 21 and second wall 22 has extending therefrom first score/time keeping panel 45*a* and the corner formed by first wall and third wall 23 has extending therefrom second score/time keeping panel 45*b*. Since first and second score/time keeping panels 45*a* and 45*b* are identical, only one such score/time keeping panel will be described in detail. First score/time keeping panels 45*a* has time display means 46 and score display means 47. In the preferred embodiment, time display means 46 and score display means 47 are light emitting diode-type displays. Time display means 46 is coupled to first time counting mechanism (TCM) 82*a* via line 2 and score display means 47 is coupled to first score accumulating mechanism (SAM) 81*a* via line 1. Likewise, time display means 46' of second score/time keeping panel 45*b* is coupled to second time counting mechanism (TCM) 82*b* via line 2' and score display means 47' of second score/time keeping panel 45*b* is coupled to second score accumulating mechanism (SAM) 81*b*. As first time counting mechanism (TCM) 82*a* and first score accumulating mechanism (SAM) 81*a* are reset so are time display mens 46 and score display means 47, respectively. Likewise, as second time counting mechanism (TCM) 82*b* and second score accumulating mechanism (SAM) 81*b* are reset so are time display mens 46' and score display means 47'.

First score/time keeping panel 45*a* automatically keeps score for the first player of the one-on-one basketball game apparatus 10 and counts down the predetermined time interval in which the first player has control via first hand-held game control device 70*a*, in the offensive playing mode, of offensive basketball player figurine 60*b*. The second player has control via second hand-held game control device 70*b*, in the defensive playing mode, of defensive basketball player figurine 60*a*. After the expiration of such predetermined time interval, player switching means 87 automatically switches first hand-held game control device 70*a* and second hand-held game control device 70*b* to the other playing mode, i.e., from the offensive playing mode to the defensive playing mode and from the defensive playing mode to the offensive playing mode, respectively.

Front surface 26 of floor member 24 has formed therein first and second game communication ports (not shown) for receiving therein connector plugs 71*a* and 71*b*, respectively, of hand-held game control devices 70*a* and 70*b*, respectively. Connector plugs 71*a* and 71*b* have coupled thereto game control panels 72*a* and 72*b*, respectively, via cables 73*a* and 73*b*, respectvely.

Since game control panels 72*a* and 72*b* are identical, only one such game control panel will be described in detail. Game control panel 72*a* comprises defensive player moving means 74, offensive player moving means 75 and basketball control means 76. Defensive player moving means 74 allows defensive basketball player figurine 60*a* to move side-to-side along first track 40*a*. Defensive player moving means 74 comprises a means for continuously moving defensive basketball player figurine 60*a* in a first direction and for continuously moving defensive basketball player figurine 60*a* in a second direction. Defensive player moving means 74 is activated when first hand-held game control device 70*a* is in the defensive mode. Defensive player moving means 74 is inactivated when first hand-held game control device 70*a* is in the offensive mode.

Offensive player moving means 75 allows offensive basketball player figurine 60*b* to move side-to-side along second track 40*b*. Offensive player moving means 75 comprises a means for continuously moving offensive basketball player figurine 60*b* in a first direction and for continuously moving offensive basketball player figurine 60*b* in a second direction. Offensive player moving means 75 is activated when first hand-held game control device 70*a* is in the offensive mode. Offensive player moving means 75 is inactivated when first hand-held game control device 70*a* is in the defensive mode.

Basketball control means 76 when actuated releases spring biasing means 63 coupled to hand 61*b* so that a force of pressure is applied to basketball 35 via hand 61.

As can be appreciated, first hand-held control device 70*a* and second hand-held control device 70*b* allow the first player to alternately control defensive basketball player figurine 60*a* when in the defensive playing mode and offensive basketball player figurine 40*b* when in the offensive playing mode.

Defensive basketball player figurine 60*a* and offensive basketball player figurine 60*b* serve to play one-on-one basketball in playing field 20 wherein defensive basketball player figurine 60*a* tries to prevent offensive basketball player 60*b* from scoring points by blocking basketball 35 from entering target 30, the basketball goal.

Defensive basketball player figurine 60*a* essentially resembles a basketball player wherein such defensive basketball player figurine maintains an erect position with its arms full extended above its head to block the ball. Offensive basketball player figurine 60*b* essentially resembles a basketball player wherein such offensive basketball player figurine 60*b* maintains a basketball shooting posture whereby hand 61*a* serves as a support to rest basketball 35 thereon and hand 61*b* serves to apply a force of pressure to basketball 35 to propel basketball 35 forward in the direction of target 30, the basketball goal.

Figure 6:
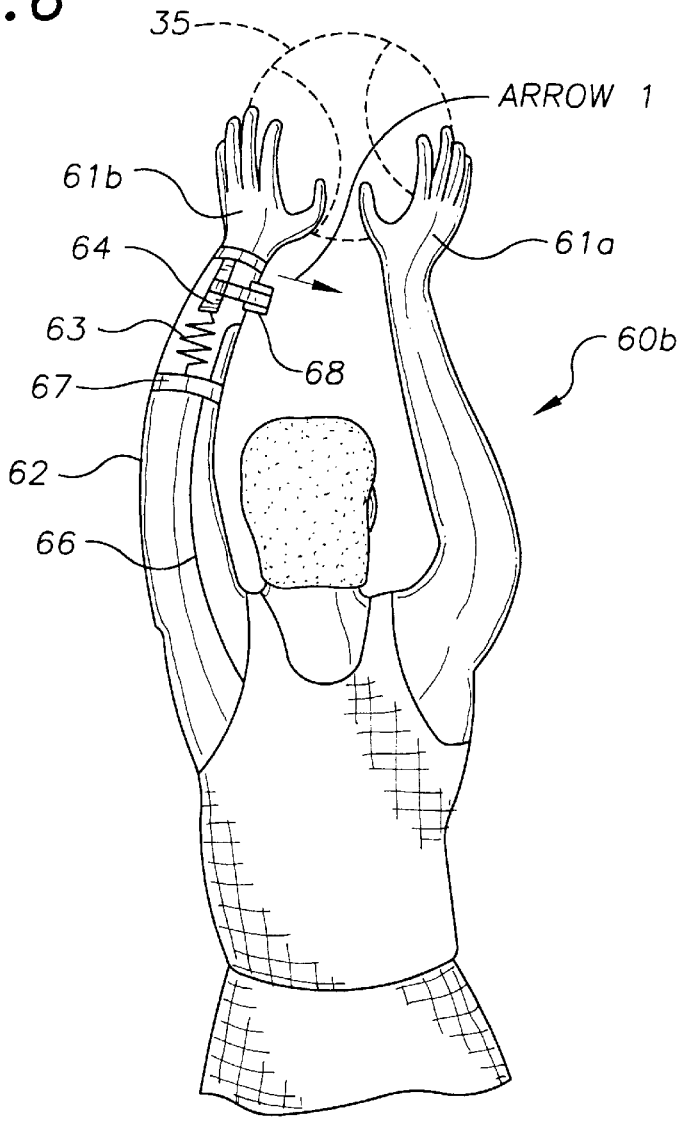

Referring now to FIG. 6, arm 62 has coupled therein spring biasing means 63. Spring biasing means 63 has coupled to one end thereof stop wall 67 wherein stop wall 67 prevents spring biasing means 63 from moving downward in arm 62 past stop wall 67. The other end of spring biasing means 63 has coupled thereto shaft 64 which is electromechanically held in place via rod member 65. Rod member 65 is journalled perpendicularly in shaft 64 when shaft 64 is in arm 62. Rod member 65, under the control of means 68, moves in the direction of ARROW 1 thereby releasing spring biasing means 63 and shaft 64. As spring biasing means 63 is released, arm 61*b* is urged upward thereby applying a force of pressure to basketball 35. Means 68 is coupled to control line 66. Control line 66 is coupled to basketball control means 76 wherein when basketball control means 76 is actuated and first hand-held game control device 70*a* is in the offensive mode, rod member 65 is moved to release spring biasing means 63. Likewise, when basketball control means 76' is actuated and second hand-held game control device 70*b* is in the offensive mode, rod member 65 is moved to release spring biasing means 63.

After, basketball 35 is released, basketball 35 is placed in hands 61*a* and 61*b* until the next shot is made. Hand 61*a* is pushed inward such that shaft 64 and spring biasing means 63 are forced into arm 62. Rod member 65 is manually pushed in a direction opposite that of ARROW 1 and journalled in shaft 64. Rod member 65 enters shaft 64 when aligned with the shaft's aperture formed therein.

Hand 61*b* is slightly cupped thereby when spring biasing means 63 is released the palm of hand 61*b* serves to propel basketball 35 upward. The fingers of hand 61*b* serves to propel the basketball 35 forward. First and second tracks 40*a* and 40*b* comprises two concentric arch-shaped tracks which allow motorized defensive basketball player figurine 60*a* and offensive basketball player figurine 60*b*, respectively, to move from one side of the court to the other side of the court along concentric arch-shaped track 40*a* and arch-shaped track 40*a*, respectively. Defensive basketball player figurine 60*a* moves along the interior arch-shaped track 40*a* closest to the goal and offensive basketball player figurine 60*b* moves along the exterior arch-shaped track 40*b* farthest from the goal.

Defensive basketball player figurine 60*a* and offensive basketball player figurine 60*b* move side-to-side within first and second tracks 40*a* and 40*b*, respectively, via first and second propulsion means 50*a* and 50*b*, respectively. Since first and second propulsion means 50*a* and 50*b* and first and second tracks 40*a* and 40*b* are essentially identical, only one such track and propulsion means will be described in detail.

Figure 4A:
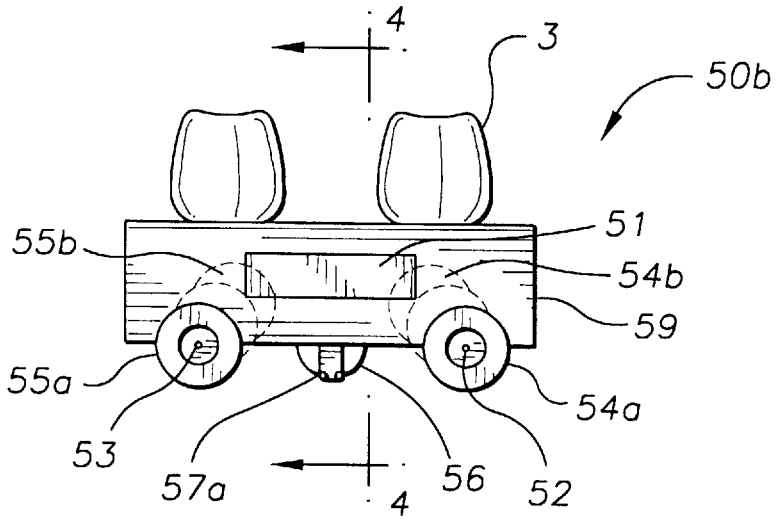
FIG. 4*a* illustrates a side view of the player propulsion means for motorizing the defensive and offensive basketball player figurines of the one-on-one basketball game apparatus of the present invention.
Figure 4B:
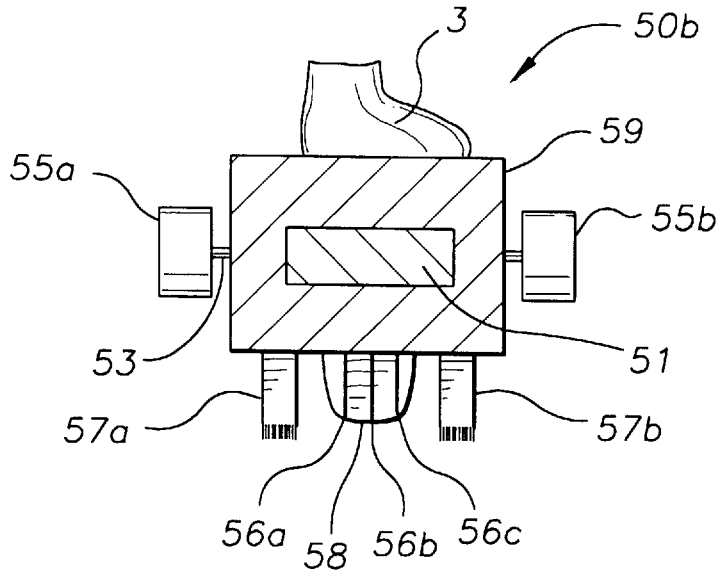
FIG. 4*b* illustrates a cross-sectional view, along the plane of 4—4 of FIG. 4*a,* of the player propulsion means for motorizing the defensive and offensive basketball player figurines of the one-on-one basketball game apparatus of the present invention.
Figure 5:
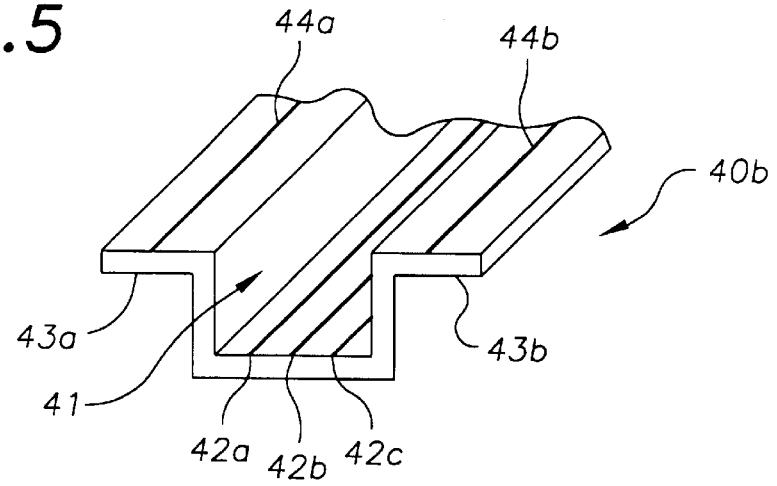
FIG. 5 illustrates a section view of the track of the present invention; and, FIG. 6 illustrates a view of the spring biased hand of the offensive basketball player figurine of the present invention.

Referring now to FIGS. 4*a*, 4*b* and 5, second propulsion means 50*b* comprises motor means 51, front axle 52 and rear axle 53, first and second front wheel members 54*a* and 54*b* and first and second rear wheel members 55*a* and 55*b*, track guide member 56, first and second direction contacts 57*a* and 57*b* and basketball actuation control signal contact 58. Motor means 51 is housed in housing 59 wherein the top surface thereof has affixed thereto shoes 3 of offensive basketball player figurine 60*b*. Front axle 52 is journalled through housing 59 wherein each end of front axle 52 has coupled thereto first front wheel members 54*a* and second front wheel member 54*b*, respectively. Likewise, rear axle 53 is journalled through housing 59 wherein rear axle 53 has coupled thereto first and second rear wheel members 55*a* and 55*b*, respectively.

Track guide member 56 is receivable within channel 41 of second track 40*b* and serves to maintain second propulsion means 50*b* in second track 40*b*. Track guide member 56 comprises first, second and third metallic surfaces 56*a*, 56*b*, and 56*c* extending around the outer circumference of track guide member 56. In the preferred embodiment, first and third metallic surfaces 56*a* and 56*c* deliver power to motor means 51 via the power source (not shown) and second metallic surface 65*b* serves to deliver a control signal to control means 68 via control line 66 in arm 62 wherein second metallic surface 65*b* serves as the basketball actuation control signal contact 58.

The bottom surface of channel 41 of second track 40*b* comprises metallic surfaces 42*a* and 42*c* which are energized by the power source (not shown). The metal-to-metal contact of metallic surfaces 42*a* and 42*c* with metallic surfaces 56*a* and 56*c* delivers power to motor means 51. Metal-to-metal contact of metallic surface 42*b* with metallic surface 56*b* communicates the control signal to control line 66.

First and second direction contacts 57*a* and 57*b* are metallic brush-like members which engage metallic surfaces 44*a* and 44*b*, respectively of flange members 43*a* and 43, respectively of second track 40*b*. In operation, first direction contact 57*a* serves to control motor means 51 to rotate front axle 52 and rear axle 53 in a first direction along second track 40*b* under the control of one of the first and second hand-held game control devices 70*a* and 70*b* when operating in the offensive mode. As front axle 52 and rear axle 53 rotate in said first direction, first and second front wheel members 54*a* and 54*b* and first and second rear wheel members 55*a* and 55*b* rotate on the flat planar surface of floor member 24 and serve to propel offensive basketball player figurine 60*b* in said first direction. Second direction contact 57*b* serves to control motor means 51 to rotate front axle 52 and rear axle 53 in a second direction. As front axle 52 and rear axle 53 rotate in said second direction, first and second front wheel members 54*a* and 54*b* and first and second rear wheel members 55*a* and 55*b* rotate and serve to propel offensive basketball player figurine 60*b* in said second direction.

First track 40*a* and first propulsion means 50*b* differs from second track 40*a* and second propulsion means 50*b* for defensive basketball player figurine 60*a* in that the track guide member does not require basketball actuation control signal contact 58. Therefore, metallic surface 56*b* of track guide member 56 and metallic surface 42*a* of channel 41 may be eliminated.

Target 30 comprises hoop member 31 having suspended therefrom net 32. Hoop member 31 has coupled thereto projecting lever member 33 wherein projecting lever member extends into hoop member 31. Projecting lever member 33 is couples to switch means 34 wherein switch means 34 is coupled to player switching means (PSM) 87. Player switching means (PSM) 87 communicates to one of first score accumulating mechanism (SAM) 81*a* or second score accumulating mechanism (SAM) 81*b*, depending one which player is in the offensive mode, when basketball passes through hoop member 31 and projecting lever member 33 closes switch means 34. Player switching means (PSM) 87 interpret that switch means 34 has been closed and the player's score is increased accordingly.

It is noted that the embodiment of the one-on-one basketball game apparatus described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A basketball game apparatus comprising:

a playing field having first and second tracks embedded in a court floor;

a target supported above said court floor;

a motorized defensive basketball player figurine coupled in said first track for movement therein;

a motorized offensive basketball player figurine coupled in said second track for movement therein;

first and second hand-held game control devices wherein each control device of said first and second hand-held control devices alternately controls the movement of said defensive basketball player figurine when in a defensive playing mode and the movement of said offensive basketball player figurine when in an offensive playing mode; and, a basketball member.

2. The apparatus of claim 1, wherein said first and second energized tracks are concentric arch-shaped tracks.

3. The apparatus of claim 1, wherein said defensive basketball player figurine essentially resembles a basketball player wherein said defensive basketball player figurine maintains an erect position with its arms fully extended above its head to block the ball; and, said offensive basketball player figurine essentially resembles a basketball player wherein said offensive basketball player figurine maintains a basketball shooting posture.

4. The apparatus of claim 3, wherein said offensive basketball player figurine comprises:

a first hand for supporting said basketball; and a second hand which is spring biased to apply a force of pressure to the basketball member to propel the basketball member forward in the direction of the target.

5. The apparatus of claim 3, further comprising:

a first score/time keeping panel for displaying a score of a first player and displaying a count down of a predetermined time interval in which said first player is in said offensive playing mode; and, a second score/time keeping panel for displaying a score of a second player and for displaying a count down said predetermined time interval in which said second player is in said offensive playing mode.

6. The apparatus of claim 3, wherein said playing field comprises:

a first wall perpendicularly coupled to a back edge of said court floor;

a second wall perpendicularly coupled to a first side of said court floor;

a third wall per perpendicularly coupled to a second side of said court floor wherein said second wall and said third wall are substantially triangularly-shaped wherein the hypothenuse of the triangularly-shaped second and third walls extends from the front to the back of said court floor.

7. The apparatus of claim 1, wherein said motorized defensive basketball player figurine is propelled in said first track by first propulsion means for propelling coupled to the feet of said motorized defensive basketball player figurine and said motorized offensive basketball player figurine is propelled in said second track by second propulsion means for propelling coupled to the feet of said motorized offensive basketball player figurine wherein said first propulsion means and said second propulsion means each comprise:

a front axle, first and second front wheel members coupled to each end of said front axle for rotation on said court floor, a rear axle, first and second rear wheel members coupled to each end of said rear axle for rotation on said court floor, and a motor means for rotating said front axle and said rear axle;

wherein said first propulsion means further comprises:

a track guide member coupled in a channel of said first track, and first and second direction contacts coupled to first and second flange members, respectively of said first track; and wherein said second propulsion means further comprises:

a track guide member, coupled in a channel of said second track, having a basketball actuation control signal contact, and first and second direction contacts coupled to first and second flange members, respectively of said second track.

8. A basketball game apparatus comprising:

a playing field having first and second tracks embedded in a court floor;

a target supported above said court floor;

a motorized defensive basketball player figurine coupled in said first track for movement therein;

a motorized offensive basketball player figurine coupled in said second track for movement therein;

first propulsion means for propelling said motorized defensive basketball player wherein said first propulsion means is coupled to the feet of said motorized defensive basketball player figurine and is receivable in a channel of said first track;

second propulsion means for propelling said motorized offensive basketball player wherein said second propulsion means is coupled to the feet of said motorized offensive basketball player figurine and is receivable in a channel of said second track;

first and second hand-held game control devices wherein each control device of said first and second hand-held control devices alternately controls the movement of said defensive basketball player figurine when in a defensive playing mode and the movement of said offensive basketball player figurine when in an offensive playing mode; and, a basketball member.

9. The apparatus of claim 8, wherein said first and second energized tracks are concentric arch-shaped tracks.

10. The apparatus of claim 8, wherein said defensive basketball player figurine essentially resembles a basketball player wherein said defensive basketball player figurine maintains an erect position with its arms fully extended above its head to block the ball; and, said offensive basketball player figurine essentially resembles a basketball player wherein said offensive basketball player figurine maintains a basketball shooting posture.

11. The apparatus of claim 10, wherein said offensive basketball player figurine comprises:

a first hand for supporting said basketball; and a second hand which is spring biased to apply a force of pressure to the basketball member to propel the basketball member forward in the direction of the target.

12. The apparatus of claim 10, further comprising:

a first score/time keeping panel for displaying a score of a first player and displaying a count down of a predetermined time interval in which said first player is in said offensive playing mode; and, a second score/time keeping panel for displaying a score of a second player and for displaying a count down said predetermined time interval in which said second player is in said offensive playing mode.

13. The apparatus of claim 3, wherein said playing field comprises:

a first wall perpendicularly coupled to a back edge of said court floor;

a second wall perpendicularly coupled to a first side of said court floor;

a third wall per perpendicularly coupled to a second side of said court floor wherein said second wall and said third wall are substantially triangularly-shaped wherein the hypothenuse of the triangularly-shaped second and third walls extends from the front to the back of said court floor.

14. The apparatus of claim 8, wherein said first propulsion means and said second propulsion means each comprise:

a front axle, first and second front wheel members coupled to each end of said front axle for rotation on said court floor, a rear axle, first and second rear wheel members coupled to each end of said rear axle for rotation on said court floor, and a motor means for rotating said front axle and said rear axle;

wherein said first propulsion means further comprises:

a track guide member coupled in a channel of said first track, and first and second direction contacts coupled to first and second flange members, respectively of said first track; and wherein said second propulsion means further comprises:

a track guide member, coupled in a channel of said second track, having a basketball actuation control signal contact, and first and second direction contacts coupled to first and second flange members, respectively of said second track.

15. A basketball game apparatus comprising:

a playing field having first and second tracks embedded in a court floor;

a motorized defensive basketball player figurine coupled in said first track for movement therein;

a motorized offensive basketball player figurine coupled in said second track for movement therein;

first and second hand-held game control devices wherein each control device of said first and second hand-held control devices alternately controls the movement of said defensive basketball player figurine when in a defensive playing mode and the movement of said offensive basketball player figurine when in an offensive playing mode;

a basketball member; and a target supported above said court floor wherein said target comprises:

a hoop member, a net, a lever means projecting in said hoop for closing a means for switching wherein when said switch means when closed indicates said basketball member has passed through said hoop member of said target.

16. The apparatus of claim 15, wherein said first and second energized tracks are concentric arch-shaped tracks.

17. The apparatus of claim 15 wherein said defensive basketball player figurine essentially resembles a basketball player wherein said defensive basketball player figurine maintains an erect position with its arms fully extended above its head to block the ball; and, said offensive basketball player figurine essentially resembles a basketball player wherein said offensive basketball player figurine maintains a basketball shooting posture.

* * * * *